US005265536A

United States Patent [19]

Millard

[11] Patent Number: 5,265,536

[45] Date of Patent: Nov. 30, 1993

[54] SYSTEM FOR COLLECTING AIRBORNE POWDER, MISTS, AND FUMES

[76] Inventor: James S. Millard, 909 S. 24th St., Allentown, Pa. 18103

[21] Appl. No.: 2,646

[22] Filed: Jan. 11, 1993

[51] Int. Cl.[5] ..... B41F 35/00; B41F 23/06; B05B 15/04; B41L 23/22

[52] U.S. Cl. ..... 101/424.2

[58] Field of Search ..... 101/424.2, 424.1; 55/385.2, 472, 419, DIG. 29; 15/300.1; 118/326, 308, 312, DIG. 1; 454/67, 49, 56, 57, 53

[56] References Cited

U.S. PATENT DOCUMENTS

| | | | |
|---|---|---|---|
| 2,710,574 | 6/1955 | Runion | 101/350 |
| 3,680,528 | 8/1972 | Sanders | 118/50 |
| 3,861,351 | 1/1975 | Bonwit | 101/424.2 |
| 3,882,818 | 5/1975 | Mowbray | 118/326 |
| 4,563,943 | 1/1986 | Bertelsen | 454/67 |
| 4,875,054 | 10/1989 | Archer et al. | 346/75 X |
| 4,882,992 | 11/1989 | Schmoeger | 101/424.1 |

*Primary Examiner*—J. Reed Fisher

*Attorney, Agent, or Firm*—Joseph J. O'Keefe; Charles A. Wilkinson

[57] ABSTRACT

A system amd method of operation for collecting and treating entrained particulate powder arising from the delivery end housing of a printing press for coating the top surfaces of sheets, comprising a hood assembly including: an open bottom hood connecting with the top of the delivery end housing and having a top opening, an internal baffle mounted therein to form a peripheral space between the baffle sides and hood side walls and baffle edges and hood end walls, a duct having its lower end connecting with the top opening of the hood and its upper end connecting with a blower/filter assembly which draws air upwardly from the press delivery end housing through the hood peripheral space, duct and blower/filter assembly for removal of the entrained particulate powder and discharge of the treated air into the pressroom.

21 Claims, 4 Drawing Sheets

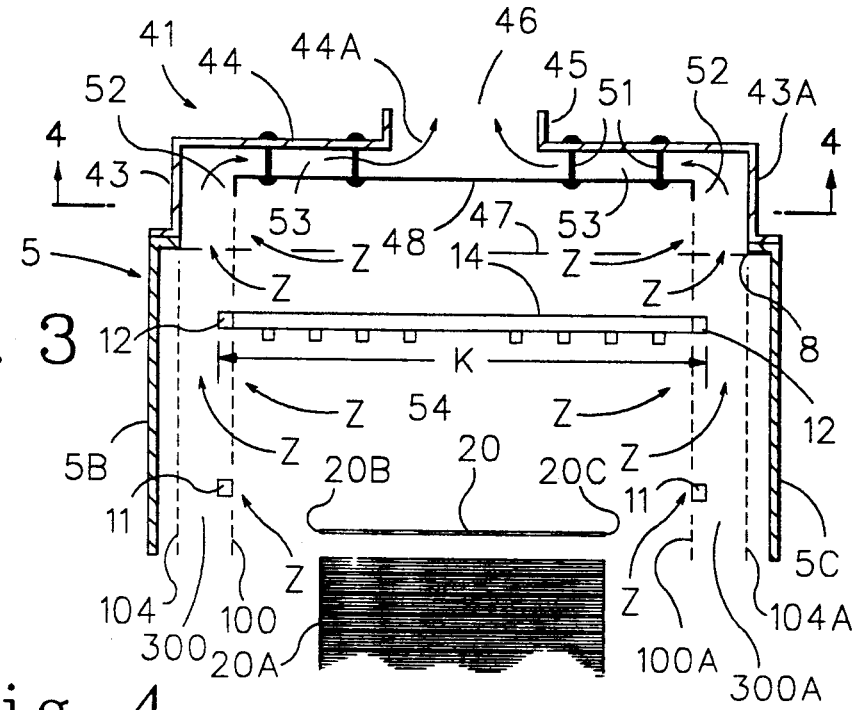
Fig. 3
Fig. 4
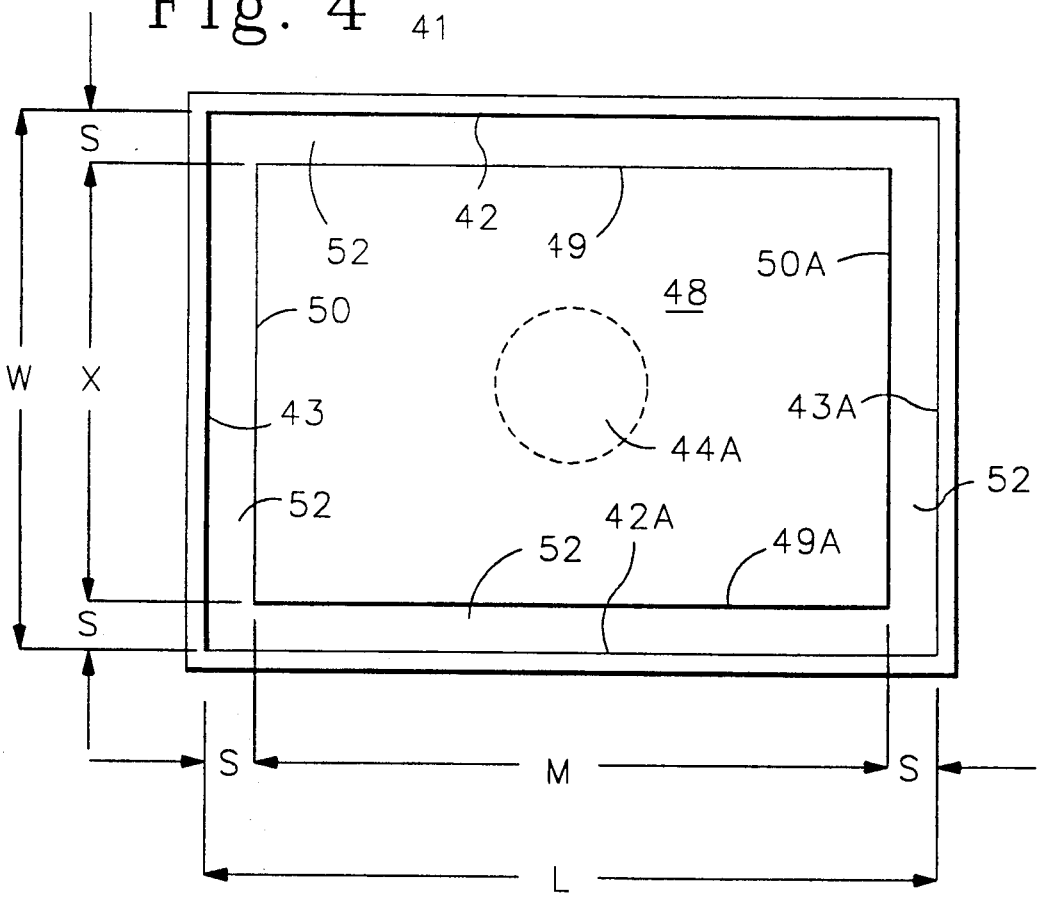

SYSTEM FOR COLLECTING AIRBORNE POWDER, MISTS, AND FUMES

This invention relates to an improved system for reducing the amount of particulate matter, mists, and fumes in the vicinity of apparatus generating them. More particularly, the invention is applicable to a system both for collecting and treating the non-adhering, airborne portion of anti-offset powder that is directed toward the surfaces of coated sheets rapidly moving through the delivery end housing to sheet stacker equipment located at the end of a printing press and for collecting and treating mists and fumes associated with certain press operations.

BACKGROUND OF THE INVENTION

Modern sheet fed printing presses, having widths as large as seventy-two inches or more, operate at such high speeds, substrate speeds of 500 feet per minute are common, that the coatings or inks applied to the sheets do not completely dry or cure before reaching the sheet stacking equipment positioned at the ends of the delivery end housings located after such presses. To deal with the problems created by the inability of such inks and coatings to adequately dry or cure before the sheets are stacked one upon another, anti-offset powders, in mixtures of generally small sizes, are often employed to prevent set-off and/or blocking. Set-off is the transfer of ink or coating from the surface of a first printed sheet to the back of the next sheet that falls on top of the first sheet. Blocking is the adhesion of several sheets of a stack of sheets due to the undried ink or coating of sheets sticking to the next adjacent sheets.

Anti-offset powder ranges in size from about five to fifty microns and is usually a starch. The most frequently used anti-offset powders are corn starch and potato starch, but wax sprays, miocroencapsulated particles, and chemically modified starches are also used, and each has certain distinct qualities. Starches may be treated with silicone to agglomerate the fine particles and assist in settling, and silica, tricalcium phosphate, and magnesia may also be added to the powders to improve their flow characteristics.

Anti-offset powder dispensers are positioned in press delivery end housings between driers, which accelerate the drying or curing of the coatings applied to the sheets that pass beneath the driers, and the sheet stackers located adjacent the ends of such housings. The amount of powder used is a function of the sheet weight and the type of ink or coating applied. The lighter the sheet weight, the less powder applied. While the powder that adheres to the non-dried portions of the coated sheets effectively prevents set-off and blocking of the sheets, the excess or airborne powder that does not adhere to the sheets contributes to many problems. A significant amount of the powder, particularly the smaller particles, directed toward the sheets does not adhere to them and remains airborne. It is estimated that about 30% of such powder adheres to the undried coatings of such sheets, about 10% is heavy enough to drift or fall downwardly to the floor, and about 60% remains airborne.

Air currents generated within and adjacent a press delivery end housing by rapid movement of the sheets and their conveying equipment, by the heat created by drying equipment in such housing, and by the descent of the sheets released from the conveyor gripper bars to the top of the stacker create turbulence. In some presses fans are installed adjacent the ends of the sheet conveyors to direct air downwardly on the tops of sheets as they are released from the conveyor gripper bars to prevent sheet fluttering. Such fans create further turbulence. The turbulence causes the airborne powder, unless collected, to circulate throughout pressrooms and ultimately deposit everywhere. The airborne powder contributes to sheet quality problems by reducing the gloss on the printed surfaces, by creating scratches and hickeys on such surfaces, and by generally causing dirty prints. The powder also penetrates into all portions of pressroom equipment, substantially increasing maintenance and cleaning costs and contributing to health and safety problems. In addition to airborne powder problems in pressrooms, the inks and coatings used in printing presses generate undesirable mists and fumes which prevade the atmosphere and create undesirable conditions.

The problems with airborne powder in high speed presses is complicated by the fact that presses come in different sizes, both with respect to the number of printing stands and the widths and lengths of the delivery end housings, print sheets of different lengths, widths and weights, operate at different speeds and are made by different manufacturers. Manufacturers of printing presses emphasize the speed of operation and mechanical features of their presses but, to date, have done little to reduce the environmental problems associated with their presses.

Various forms of apparatus, methods, and systems have been proposed and tried for dealing with the problems resulting from the use of inks, coating materials, and anti-offset powders in the operations of high-speed printing presses. For example, in some pressrooms, hoods, connected to a vacuum system, have been placed above the ends of the delivery end housings of a number of presses to collect excess, airborne powder. Gates or dampers placed in the ducts between each of the hoods and the vacuum system are adjusted to control the degree of suction within the hood. In addition, many patented inventions have been proposed to deal with such pressroom problems.

U.S. Pat. No. 3,434,416 to A. O. Testone describes a printing press excess-powder collector that provides a housing about a powder dispensing nozzle which is located above coated sheet material moving through the housing. Excess powder is removed from the housing by a blower or fan that draws such powder and air through a collection compartment in which the powder is electrostatically removed from the air.

U.S. Pat. No. 3,680,528 to R. C. Sanders is directed to apparatus for removing airborne powder following the application of powder material to a moving surface. A manifold for collecting the airborne powder is positioned after the powder dispensing apparatus. The powder collected in the manifold is moved by a fluid stream to the ends of the manifold where it is exhausted by a gentle vacuum to an exhaust trap.

U.S. Pat. No. 3,882,818 to K. D. Mowbrey is directed to a system for collecting excess airborne powder from powder applied to the surfaces of sheets passing from a printing press. The collecting apparatus is located adjacent and following a powder applicator and comprises a plurality of modules that extend transversely of the direction of travel of such sheets, between the sheet conveyor flights and above the upper flight. The modules have inlet openings along their bottoms and/or one side thereof and gates to vary the size of the openings. The excess powder and air are drawn into the module openings which are connected by conduits to an exhaust manifold which is supported on a plate positioned above the conveyor upper flight.

U.S. Pat. No. 2,710,574 to H. E. Runion is directed to apparatus for eliminating undesirable dust or ink mist from pressrooms. Each press in a pressroom is surrounded by an enclosure having a plurality of small openings adjacent the top of the enclosure. Each enclosure is connected by a first passage to a plenum chamber which communicates through a filter with a second plenum chamber. The second chamber communicates through a second passage with a blower or fan. The fan draws air through the enclosure openings, the enclosure, the first passage and through the filter separating the plenum chambers, through the second passage, and discharges the air through a third passage to a desired location.

U.S. Pat. No. 4,563,943 to M. H. Bertelsen et al. is directed to apparatus for filtering the air passing from the top discharge opening of a computer room for housing a high-speed paper-handling machine, such as a laser printer. The apparatus includes a sheet metal wing that extends over the top opening of the housing and connects with filter apparatus. The wing has a bottom inlet opening that faces the housing top opening to receive air from the printer. The wing includes a longitudinally extending baffle that extends between the wing sidewalls and divides the wing inlet opening into upper and lower inlet portions of equal size.

U.S. Pat. No. 4,875,054 to T. H. V. Archer is directed to a somewhat different invention that makes use of an air curtain in fluid jet printing apparatus. The patent discloses a clean air hood for disposition directly above the print head of a fluid jet printing device. The device has an orifice plate on one side of the print head for forming a plurality of droplets that flow downwardly past charge and deflection electrodes and a fluid catcher. The charge electrode imparts a charge to certain droplets which are caught on the fluid catcher for recycling, while the uncharged droplets are deposited on a substrate beneath the electrodes and the fluid catcher. The hood includes an interior baffle to direct clean air from above the hood downwardly through the hood so that it passes through spaced slots on opposite sides and opposite ends of the baffle to form descending air curtains that straddle the print head and minimize the tendency of the droplets contacting the electrodes.

OBJECTS OF THE INVENTION

An object of the present invention is to provide a system both for effectively collecting and treating airborne powder resulting from the dispensing of a range of finely sized powder onto the coated surfaces of sheet material rapidly conveyed from the last stand of a high-speed printing press and for collecting and treating mists and fumes associated with the operation of such a press.

Another object of the invention is to provide a system of simple and inexpensive construction which readily can be adapted to existing and new printing presses, without extensive design and manufacturing modifications, to effectively collect and remove both airborne powder circulating adjacent apparatus for applying such powder to the surfaces of printed material and for collecting and treating mists and fumes associated with the operation of such presses.

It is another object of this invention to provide a method for effectively collecting airborne powder from the vicinity of equipment for applying such powder to the surfaces of rapidly moving coated material passing beneath such equipment.

SUMMARY OF THE INVENTION

The present invention overcomes the deficiencies and disadvantages of prior art systems for collecting and treating both ink mists and fumes arising from the operation of printing presses and airborne powder resulting from the application of fine, anti-offset powder to coated surfaces, such as printed sheet material and the like. The printing press ink mist and fume and powder collection system of this invention includes a hood assembly, with an internal baffle, a blower/filter assembly, and a duct that extends between the top of the hood assembly and an end of the blower/filter assembly.

The hood assembly has an open bottom and is mounted after powder dispensing apparatus positioned in the beginning portion of the delivery end housing associated with the last stand of a multi-stand, high-speed, sheet-fed printing press and above an intermediate portion of such housing. The blower/filter assembly is suspended from a pressroom ceiling above the hood to which it is connected by a duct. The lower perimeter of the open-bottom hood assembly connects with the top of the intermediate portion of the delivery end housing so the open-bottom is coincidental with the top opening of such housing and directly above at least a portion of the sheet stacker, which is below and spaced from the end of such housing. Manufacturers of presses design such housings with top openings to permit easy access to powder dispensing and other equipment located in the housings.

The hood extends transversely of the direction of flow of sheets from the press and of the length of the delivery end housing and has a length about equal to the width of the housing. The width of the hood is about equal to the width of the housing top opening. The hood has a top central opening to which is connected the lower end of the duct that extends upwardly to one end of the blower/filter assembly. The hood baffle is mounted horizontally intermediate the hood height, spaced from the hood top, and extends across the hood top opening toward the hood side and end walls, stopping short thereof to provide a peripheral space, between two to four inches wide, that extends substantially about the hood periphery, between the baffle ends and hood ends and between the baffle sides and hood sides. The hood baffle is spaced two to four inches below the hood top and between eleven and seventeen inches above the path of movement of the press conveyor chain lower flight that rapidly carries the coated sheets through the delivery end housing, i.e. beneath the powder dispensing equipment, and over the housing bottom opening at which location each of such sheets is released from a gripper bar and drops to the stacker.

The blower/filter assembly includes a housing having a central compartment and an end compartment on each side thereof. Mounted in the central compartment is a blower powered by a motor. The blower has side air inlet openings which permit air to be drawn from the central compartment and discharged through a front opening and louvre in the side of the housing. Each end compartment has an air inlet port in its outer end, connects at its inner end with the housing central compartment, and has three sections. The outer section includes a first filter media for removal of larger dirt and powder particles. The intermediate section includes a second filter media for removal of ink mists and fine dust and powder particles. The inner section includes a third filter media for removal of selected contaminants, such as ammonia and other fumes, from coatings applied to sheet materials. The duct connects at its lower end with the hood assembly top opening and extends to and connects at its upper end with the air inlet port in the outer end of one of the end compartments of the blower filter assembly housing.

The blower of the above described system operates to create a suction within the housing central compartment, the suction draws air through the air inlet port at the outer end of each end compartment of the blower/-filter assembly housing.

The suction that draws air through the inlet port of the first end compartment also pulls air upwardly through the duct connected to it, through the hood at the lower end of the duct and through the delivery end housing. The suction creates upwardly moving curtains of air within the lower portion of the hood, at its periphery, within the portion of the delivery end housing beneath the hood, and adjacent the tops and sides of the sheets on the stacker beneath the delivery end housing. The upwardly moving curtains of air carry entrained powder particles and fumes from the delivery end housing through the lower portion of the hood, through the perimeter opening between the hood side and end walls and across the top of the hood baffle, through the hood top opening, and through the duct connecting with the air inlet port of the first end compartment of the blower/filter assembly housing. Within the first end compartment the air with entrained powder particles and fumes is drawn through the first, second and third filter media, which substantially remove the powder particles and fumes, i.e. cleans the air. The clean air is drawn into and discharged from the blower into the pressroom.

The suction created by the blower within the blower/filter assembly housing central portion draws air through the air inlet port at the end of the second end compartment, this air carrying dust and ink mists circulating within the pressroom passes through the second end compartment first, second and third filter medias which substantially remove the dust and ink mists, i.e. cleans the air. The clean air is drawn into and discharged from the blower into the pressroom.

BRIEF DESCRIPTION OF THE DRAWINGS

The nature of the invention will be more clearly understood by reference to the following description, the appended claims and the several views illustrated in the accompanying drawings.

FIG. 3 is a sectional view taken along the line 3—3 of FIG. 2.

FIG. 4 is an enlarged sectional view taken along the line 4—4 of FIG. 3.

PREFERRED EMBODIMENT OF THE INVENTION

Figure 1:
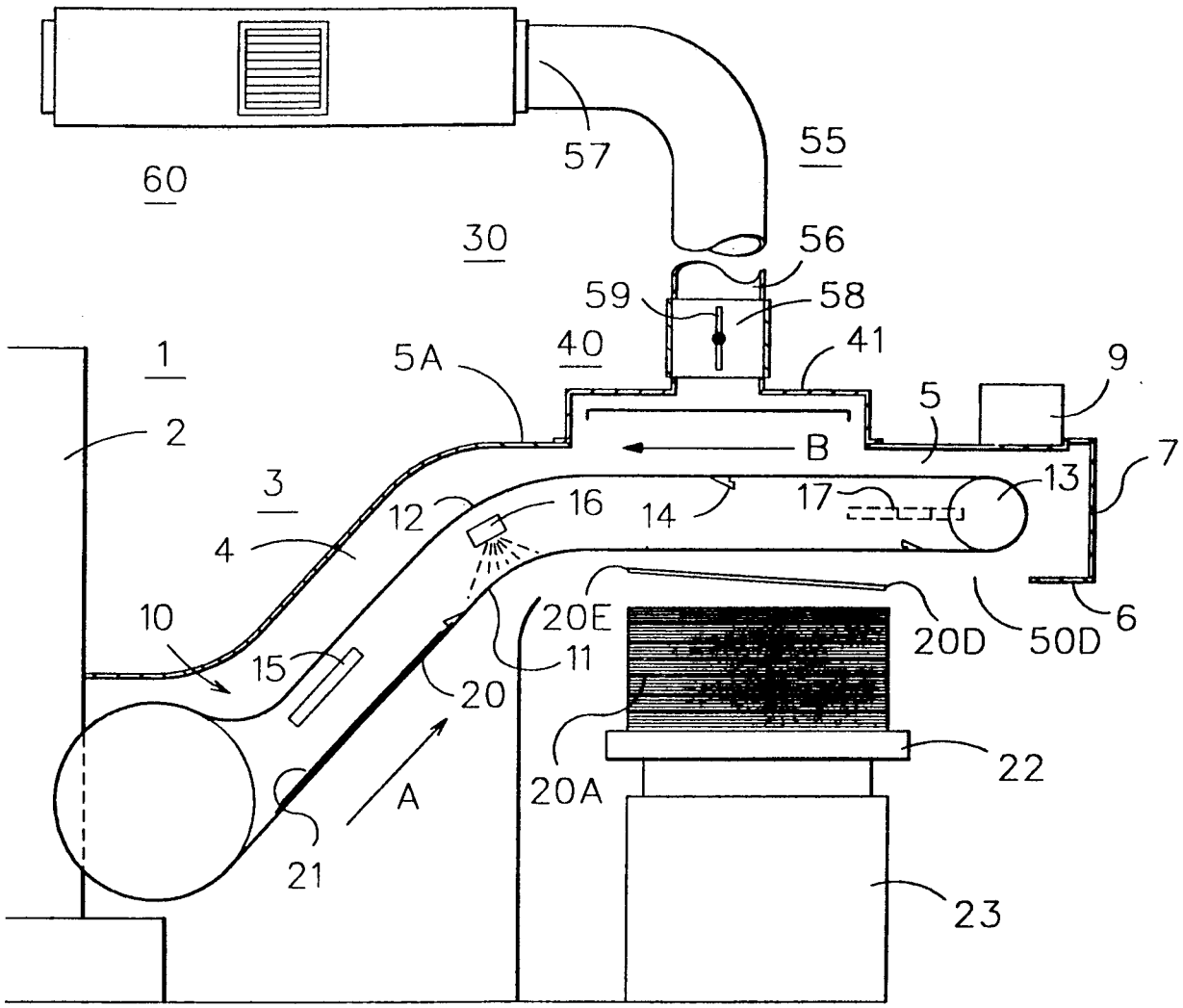
FIG. 1 is a schematic cross-sectional view of a portion of the auxiliary apparatus of a multi-stand, multicolor, sheet-fed printing press, including the delivery end housing, and the apparatus of this invention for collecting and treating the airborne offset plowder used with such presses and other contaminants resulting from the operation of such presses.
Figure 2:
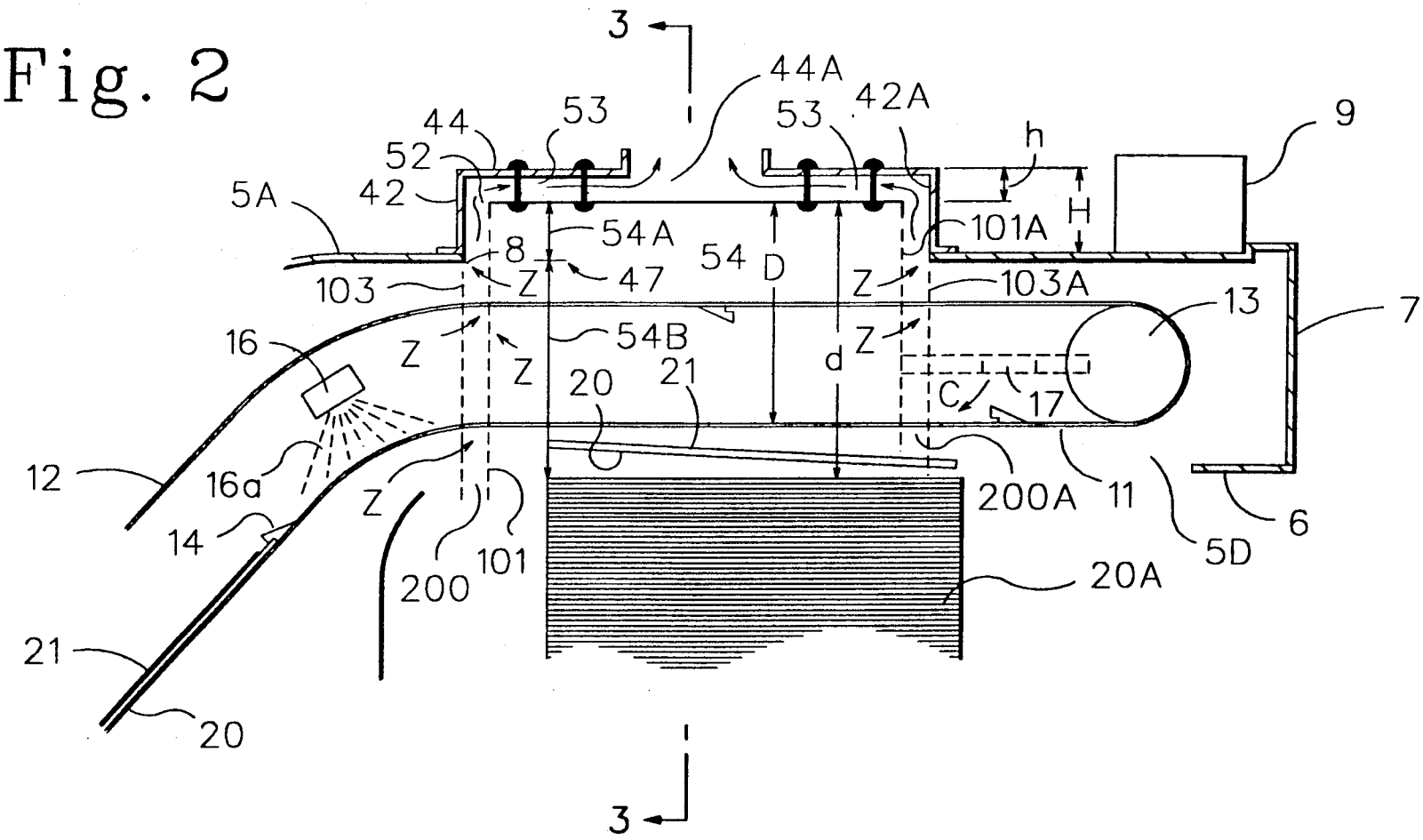
FIG. 2 is an enlarged sectional view of a portion of the press delivery end housing of FIG. 1 illustrating details of the apparatus of the invention.

Referring to FIGS. 1, 2, and 3 there is shown a portion of a multi-stand printing press 1, mounted in a pressroom, having final stand 2, and delivery end housing 3 immediately following such stand. Housing 3 has inclined portion 4 and horizontal portion 5 which has end 6 covered by hinged access door 7. Housing 3 has top 5A, sides 5B and 5C, and horizontal portion 5 has generally open bottom 5D. Housing top 5A has rectangular opening 8 which extends from side 5B to side 5C and mounted on such top, adjacent horizontal portion end 6, is press control box 9. Conveyor 10, having a width K, with bottom flights 11 and top flights 12 moves in a fixed path through press 1 and delivery end housing 3. Bottom flights 11 move in the direction shown by arrow A, proceed about sprockets 13 mounted adjacent housing end 6 and become top flights 12 which move in the direction shown by arrow B. Spaced along conveyor 10 and in a direction perpendicular to the direction of movement of flights 11 and 12 are gripper bars 14.

Mounted within press delivery end housing inclined portion 4 is drier assembly 15, and mounted thereafter, adjacent the junction of delivery end inclined portion 4 and horizontal portion 5, is anti-offset powder dispensing apparatus 16. Powder dispensing apparatus 16 extends on a line perpendicular to housing side walls 5B and 5C. between conveyor lower flights 11 and upper flights 12. Between conveyor lower flights 11 and upper flights 12, adjacent sprockets 13 are fans 17, marked in phantom lines, as they are not included in all delivery end housings. Sheets 20, each having sides 20B and 20C, which travel parallel to housing sides 5B and 5C, respectively, and forward end 20D and back end 20E, are fed through press 1 to delivery end housing 3. Sheets 20 are locked in spaced positions on conveyor 10 by gripper bars 14 and moved through the several stands of the press at which locations ink or other desirable coating is applied to the top surface 21 of each such sheet.

After final stand 2, each sheet 20 is moved upwardly by chain conveyor lower flights 11 through housing inclined portion 4 and passes adjacent drier assembly 15, which functions to dry or cure the ink or coating on top surface 21 of each such sheet. Each sheet 20 then passes beneath powder dispensing apparatus 16, which directs anti-offset powder **16*a* toward the sheet coating on the top surface 21 of each such sheet. A portion of such powder adheres to the undried portion of the coating and the non-adhering portion of the powder becomes airborne and is carried by sheets 20 or drifts or is carried by air currents into the horizontal portion 5 of delivery end housing 3. Ink mists from press 1 and fumes resulting from the application of heat by drier assembly 15 to the coatings on the top surfaces 21 of sheets 20 also are carried by air currents into the horizontal portion 5 of delivery end housing 3**.

Adjacent the junction of delivery end housing inclined portion 4 and horizontal portion 5, after dispensing apparatus 16, gripper bar 14 holding each sheet 20 on conveyor bottom flights 11 releases such sheet. The sheet 20 drops a short distance through housing open bottom 5D and onto the top of previously released stacked sheets 20A which accumulate on pallet 22 of stacker mechanism 23. Fans 17, shown in phantom, direct air downwardly in the direction shown by arrow C to prevent sheet flutter. The anti-offset powder adhering to the coating on top 21 of each sheet 20 acts to prevent the next succeeding sheet from adhering to such coating. As each coated sheet 20 drops through delivery end housing open bottom 5D and onto the previous sheet 20 of the stacked sheets 20A resting on pallet 22, excess powder is flushed from the previous sheet by the settling of the subsequent sheet. The excess powder migrates outwardly from the perimeter of the sheet stack 20A.

As best shown in FIGS. 1, 2 a 3, powder collection system 30 of this invention with horizontal portion 5 of press delivery housing 3. System 30 includes hood assembly 40, connecting duct 55, and blower/filter assembly 60.

As best shown in FIGS. 1–4, hood assembly 40 is positioned after and above powder dispensing apparatus 16 and includes hood 41 of rectangular shape having side walls 42 and 42A, end walls 43 and 43A, top 44, top opening 44A, hood open bottom 47. Collar 45 extends upwardly of hood top 44 and has open top 46. Hood open bottom 47 registers with top opening 8, having a rectangular shape, of top 5A of press delivery end housing 3. Hood side walls 42 and 42A and end walls 43 and 43A, respectively, are flanged at their lower ends, not identified. The hood flanges connect with top 5A of delivery end housing horizontal portion 5 in a manner to provide a reasonably airtight seal between the bottoms of such flanges and the upper surface of housing top 5A, around the perimeter of the housing top opening 8. A piano hinge arrangement, not shown, at the top of the side wall 42 of hood 41 permits such side wall to be opened conveniently for access to the interior of delivery end housing horizontal portion 5. As shown in FIGS. 2, 3, and 4, hood 41 has a length L about equal to the width of delivery end housing top opening 8, i.e. transverse to the direction of flow of sheets 20, and a width W about equal to the length of delivery end housing top opening 8, i.e. in the direction of flow of such sheets. Length L of hood 41 is at least as long as the width K of conveyor 10 and is larger than the width of the widest sheet fed through press 1.

As best shown in FIGS. 2, 3 and 4, mounted centrally within hood 41 is baffle 48 of rectangular shape having sides 49 and 49A and ends 50 and 50A. Baffle 48 is suspended by hangers 51 from hood top 44 and extends generally in an uninterrupted manner and parallel to hood top 44, across hood top opening 44A toward hood side walls 42 and 42A and end walls 43 and 43A, respectively. Baffle 48 is smaller in horizontal cross-sectional area than hood 41 and has a length M about six inches shorter than the length L of hood 41 and a width X about six inches shorter than the width W of hood 41. By virtue of the difference in cross-sectional areas of hood 41 and baffle 47, and the central positioning of baffle 48 within such hood, a narrow peripheral space 52 having a uniform width S of about three inches exists within hood 41, between baffle sides 49 and 49A and hood side walls 42 and 42A, respectively, and baffle ends 50 and 50A and hood end walls 43 and 43A, respectively.

Hood 41 has a height H and, preferably, baffle 47 is spaced a distance h, about one third of height H, below hood top 44. Thus, a space or upper chamber 53 exists between the top of baffle 48 and the inner surface of hood top 44. Upper chamber 53 is substantially open or clear of obstructions, except for baffle hangers 51.

As shown in FIGS. 2, 3, and 4, lower chamber 54 extends between the bottom of baffle 48 and top surface 21 of each sheet 20 as it moves on conveyor bottom flight 11 through housing horizontal portion 5 and drops from gripper bar 14 onto the top sheet of stacked sheets 20A on pallet 22. The height of lower chamber 54 varies between the distance D extending from the underside of baffle 48 to about the elevation of lower conveyor flight 11, at which elevation each sheet 20 is held by a gripper bar 14, and the distance d extending from the underside of baffle 48 to the elevation of the topmost sheet 20 of the stack of such sheets on pallet 22. Chamber 54, conceptionally, is defined by vertical planes 100 and 100A, shown in phantom, extending downwardly, generally parallel the housing sides 5B and 5C, from the ends 50 and 50A, respectively, of baffle 48 and by vertical planes 101 and 101A, shown in phantom, extending downwardly, perpendicular to housing sides 5B and 5C, from sides 49 and 49A, respectively, of baffle 48. Upper portion 54A of lower chamber 54 within hood 41 is open and clear of obstructions and chamber lower portion 54B, within housing horizontal portion 5, is substantially open and clear of obstructions, i.e. obstructed only by conveyor lower and upper flights 11 and 12, respectively, gripper bars 14, and portions of any fans 17 which may partially extend into chamber lower portion 54B. All of such latter elements occupy a very small percentage of the space within chamber lower portion 54B, hence the term substantially open and clear of obstructions.

Figure 5:
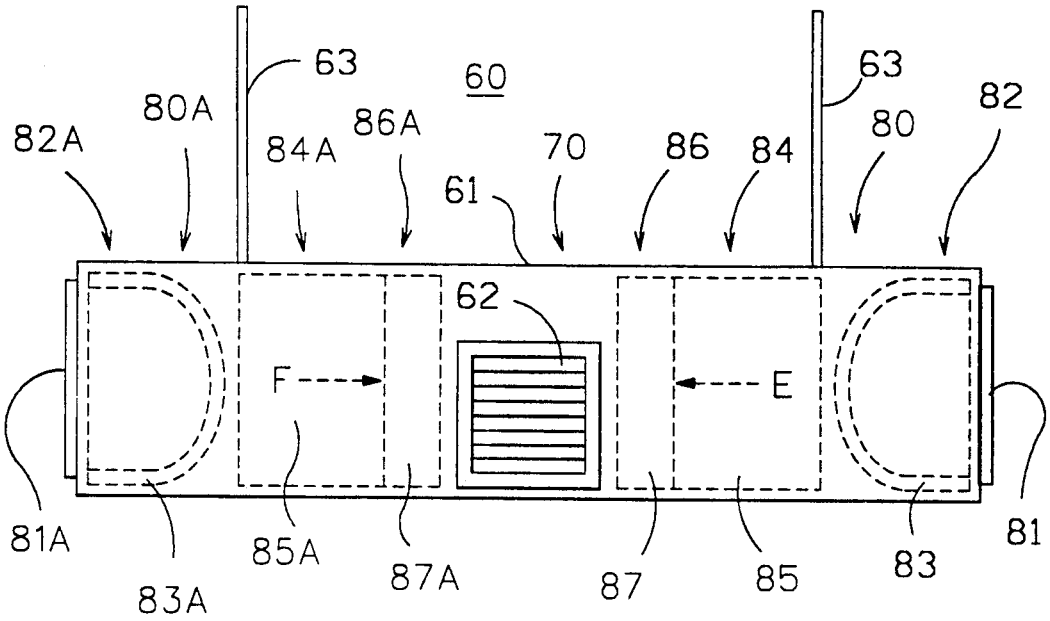
FIG. 5 is a view of a portion of the apparatus of this invention shown in FIG. 1 and illustrating in phantom certain details of the portion of such apparatus.
Figure 6:
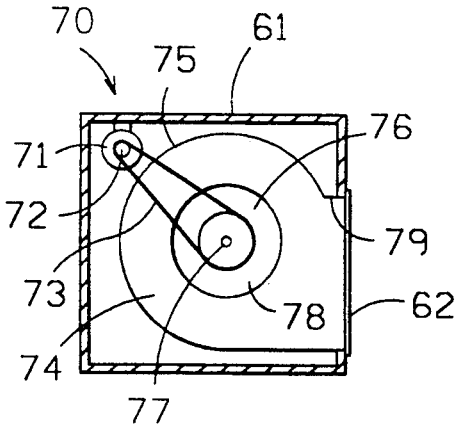
FIG. 6 is an enlarged sectional view through the central portion of the apparatus of FIG. 5.

As best shown in FIGS. 5 and 6 blower/filter assembly 60 includes sheet metal housing 61 having central compartment 70 and end compartments 80 and 80A, each of which has an outer end air inlet port 81 and 81A, respectively. Housing 61 is suspended by hangers 63 from a pressroom ceiling, not shown.

Mounted within central compartment 70 is motor 71, which is connected to a suitable source of power, not shown. Motor drive pulley 72 is mounted on the outer end of the motor shaft, not shown. Also mounted within compartment 70 is blower 74. Blower 74 has shell 75, with side air inlet openings 76, blower shaft 77, with driven pulley 78 mounted on the outer end thereof, and shell air discharge portion 79 which connects with housing louvered opening 62. A drive belt 73 extends between motor drive pulley 72 and blower driven pulley 78 in a manner known to those skilled in the art.

End compartment 80 includes outer section 82 with outer filter media 83, intermediate section 84 with intermediate filter media 85, and inner section 86 with inner filter media 87. End compartment 80A is designed in a similar fashion and includes outer section 82A with outer filter media 83A, intermediate section 84A with intermediate filter media 85A and inner section 86A with inner filter media 87A.

As shown in FIGS. 1 and 4, duct 55 has a lower end 56, which connects with the upper end of duct sleeve 58 and upper end 57, which connects with inlet port 81 of end compartment 80 of blower/filter assembly housing 61. Duct sleeve 58 connects at its lower end with open collar 45 of hood top 44 and has damper 59.

Preferably motor 71 mounted within hood housing central compartment 70 is about two horsepower, and blower 74 is a squirrel cage type with side air inlet openings 76 and a rated capacity of about 4,000 cfm.

The capacity of blower 74 can be modified by substituting a different size pulley for motor drive pulley 72 or blower driven pulley 78 or by using a larger motor, as is well known to those skilled in the art.

Outer filter media 83 of housing outer section 82 is generally of concave configuration with its open end facing air inlet port 81. This permits air with entrained mist or powder particles to enter section 82 without encountering a filter media barrier immediately adjacent inlet port 81. Filter media 81 may be of polyester construction of a type manufactured by Facet Purolator Company of Henderson, N.C. and sold under the trade name Poly PAK. Filter media 83 acts as a pre-filter to remove the larger dust and powder particles entrained in the air passing to such filter media.

Intermediate filter media 85 of housing end compartment intermediate section 84 consists of a plurality of filtering pockets which are made of micro-fiber fiberglas which are connected and inflated by the air stream flowing through such media when blower 74 is operating. One type of such filter media is the FACET PAK manufactured by Facet Enterprises of Henderson, N.C. Inner filter media 87 of housing end compartment inner section 86 consists of a chemical filter, such as charcoal impregnated with potassium magnate.

The system of this invention operates in conjunction with press 1 as follows. Sheets 20 locked in position on chain conveyor lower flight 11 by gripper bars 14 pass through press 1 where ink or a coating is applied to top 21 of each such sheet. Sheets 20 pass from final stand 2, beneath drier assembly 15, which functions to dry ink or coatings on such sheets, and continue beneath dispensing apparatus 16, which directs anti-offset powder **16*a* toward the ink or coating on top 21 of each such sheet. A portion of powder 16*a* adheres to undried areas of such ink or coating. The non-adhering portion of such powder remains airborne and with ink mist from press 1 and coating fumes, moves into delivery end housing horizontal portion 5 by virtue of the movement of sheets 20, in the direction shown by arrow A of FIG. 1, and associated air currents. The heavier particles of such powder descend through housing horizontal portion open bottom 5D and drop to the pressroom floor. The remaining particles of such powder remain airborne and with the ink mist and coating fumes are concentrated within housing horizontal portion 5 and particularly, within chamber 54, confined by housing top 5A, sidewalls 5B and 5C, and hood 41 and baffle 48. In those presses which have fans 17 adjacent housing end 6 directing a gentle breeze onto the top surfaces 21 of sheets 20 after they are released from gripper bars 14, the fans tend to direct airborne powders, ink mist and coating fumes back into chamber 54**.

Concurrently with the operation of press 1, motor 71 operates to drive blower 75 which draws air through its shell side inlet openings 76 from blower/filter assembly housing central compartment 70. This in turn creates a suction within central compartment 70 and draws air in the direction shown by arrow E in FIG. 5 through housing end compartment inner section 86, intermediate section 84, outer section 82 and air inlet port 81, and upwardly through connecting duct 55. As shown in FIGS. 1–4, the air moving upwardly through duct 55 is drawn through hood upper chamber 53, between the underside of hood top 44 and the top of baffle 48, and through peripheral space 52 between baffle sides 49 and 49A and hood side walls 42 and 42A and baffle ends 50 and 50A and hood end walls 43 and 43A.

As shown in FIGS. 2 and 3, the upward movement of air through hood peripheral space 52 creates four curtains of upwardly moving air about chamber 54. The curtains of air are defined on the inner portions thereof by planes identified by phantom vertical lines 100, 100A and 101 and 101A which encompass or surround chamber 54. The curtains of air are defined on their outer portions by hood side walls 42, 42A and end walls 43 and 43A and vertical planes extending downwardly therefrom and identified by phantom vertical lines 103 and 103A and 104 and 104A, respectively. As shown in FIG. 2, air curtain 200 moving upwardly between planes identified by lines 101 and 103 and air curtain 200A moving upwardly between planes identified by lines 101A and 103A extend perpendicular to housing side walls 5B and 5C. As shown in FIG. 3, air curtains 300 moving upwardly between planes identified by lines 100 and 104 and air curtain 300A moving upwardly between planes identified by lines 100A and 104A extend parallel to housing side walls 5B and 5C.

The upwardly moving curtains of air draw air and airborne powder, ink mist, and fumes into such curtains, as shown by arrows Z, from housing horizontal portion 5 and hood 41, beneath baffle 48, particularly from chamber 54, and from the vicinity of the upper portion of stacked sheets 20A on pallet 22. Air curtain 200A which extends transversely of housing horizontal portion 5 and adjacent sprocket 13 and which encounters fans 17 in those presses which have them, effectively act to entrain airborne powder above fans 17 but does not act as effectively below such fans due to the downward air currents created by such fans.

The airborne powder, ink mist, and fumes carried upwardly by such air curtains pass through hood peripheral space 52, hood upper chamber 53, out of hood top opening 44A, into connecting duct 55 to air inlet port 81 of blower/filter assembly 60. Within filter housing 61, the air, with airborne powder, ink mist, and fumes, passes through outer filter media 83 of housing end compartment outer section 82 and through intermediate filter media 85 of end compartment intermediate section 84. Outer filter media 83 removes the larger particles of airborne powder and intermediate filter media 85 removes the finer particles of airborne powder. The air with the larger and finer airborne powder particles removed passes through inner filter media 87 of housing inner section 86, which acts to substantially remove ink mists and any fumes remaining in such air. The cleaned air then is drawn into housing central compartment 70 through blower shell side inlet openings 76 and is discharged through blower shell discharge portion 79 and louvre 62 into the pressroom.

Dust particles, fumes, and ink mists circulating outside press 1 within the pressroom are treated by blower filter assembly housing end compartment 80A in the same manner as that described above for the airborne powder, ink mist, and fumes passing through housing end compartment 80. Blower 75 operates to draw air through its shell side inlet openings 76 from housing central compartment 70 creating a suction which draws air, with entrained contaminants, i.e. dust particles, ink mists, and fumes, in the direction shown by arrow F, circulating within the pressroom through air inlet port 81A of housing end compartment 80A. The air, with contaminants, passes through outer filter media 83A of housing end compartment outer section 82A and then through intermediate filter media 85A of housing end compartment intermediate section 84A. The larger dust particles are filtered from the contaminated air by outer filter media 83A and the finer dust particles are filtered from the contaminated air by intermediate filter media 84A. The air passes to housing end compartment inner section 86A where the entrained ink mists and fumes are removed by inner filter media 87A. The cleaned air then is drawn into housing central compartment 70 through blower shell side inlet openings 76 and is discharged through blower shell discharge portion 79 and louvre 62 into the pressroom.

In the United States the most common presses are designed to print material that has a width between twenty-four and forty-eight inches. The above described embodiments of the invention are applicable to presses which print material having a width of forty-eight inches. Hood 41 has a height H of about nine inches, has a width W of about thirty-six inches and a length L of about fifty-four inches, a cross-sectional area of about 1944 inches. Baffle 48 mounted within hood 41, is spaced a distance h of about three inches below hood top 44. Baffle 48 has a width X of about thirty inches and a length M of about forty-eight inches. Hood peripheral space 52 between baffle sides 49 and 49A, respectively, and hood sidewalls 42 and 42A, respectively, and baffle ends 50 and 50A, respectively and end walls 43 and 43A has, respectively, a width S of about three inches.

Blower 75 has a capacity of about 4000 CFM and operates within housing central compartment 70 to draw about 50% of its capacity, i.e. about 2000 CFM, through each of housing end compartments 80 and 80A. Thus, about 2000 CFM of air, with entrained powder, ink mist, and fumes, is drawn through housing horizontal portion 5, hood assembly 40, connecting duct 55, and blower/filter assembly housing end compartment 80, where such air with contaminants is treated, to housing central compartment 70. The remaining 2000 CFM of air, with dust particles, fumes, and inks, circulating within the pressroom are drawn through blower/filter assembly housing end compartment 80A, where such air with contaminants is treated, to housing central compartment 70. Hoods having a width of between twenty and forty inches and a length of between thirty and sixty inches, a cross-sectional area of between 600 and 2400 square inches, effectively deal with press anti-offset powder problems when operated with 2000 CFM of air.

When the length of and the width of the hood 41 are such that the cross-sectional are exceeds 2400 square inches, the hood 41 should be operated with a volume of air greater than 2000 CFM, preferably about 4000 CFM. With such larger hood installations it is desirable to have connecting duct 55 divided above sleeve 58 into two branches, with one branch connecting with air inlet port 81 of housing end compartment 80 and the other branch connecting with air inlet port 81A of end compartment 80A. With this type of operation, 4000 CFM of air is used solely to collect and treat airborne anti-offset powder, ink mists, and fumes passing through hood assembly 40. The contaminated air within the pressroom must be treated in another manner. Duct damper 59, shown in FIG. 1, may be used, if necessary, to balance the operation of hood assembly 40.

For air flow purposes, baffle 48 may be constructed with downwardly extending flanges, not identified, at sides 49 and 49A and ends 50 and 50A. Hood sidewalls 42 and 42A, end walls 43 and 43A, top 44 and baffle 48 are made of generally flat and smooth sheet metal. The term "generally flat" refers to the normal condition of sheet metal, except for the X-shaped cross-brakes made by fabricators of large-surface metal parts to provide rigidity to such parts in the manner well known to those skilled in the art.

While this invention has been described with respect to several examples, modifications and variations may be made by those skilled in the art without departing from the spirit and scope of the invention as defined in the appended claims.

I claim:

1. A hood assembly for a system for collecting and treating air entrained powder particles arising from the operation of a multi-stand printing press, including a delivery end housing having a top opening, a conveyor having upper and lower flights with spaced gripper means for moving coated sheets through the press and delivery end housing, dispenser means for applying powder downwardly onto the coated surfaces of the sheets for adherence to uncured portions thereof to promote effective stacking of the sheets, a duct with first and second ends associated with the system, and blower/filter means having one end thereof connecting with the first end of said duct, comprising:

(A) a hood having:
  (1) an open bottom connecting with the top of the delivery end housing, and registering with the top opening therein,
  (2) side walls,
  (3) end walls, and
  (4) a top having an connecting with the second end of said duct;

(B) a baffle mounted within the hood and having:
  (1) sides, and
  (2) ends;

(C) a peripheral space within the hood between the baffle sides and the adjacent hood side walls and between the baffle ends and the adjacent hood end walls whereby operation of the blower/filter means draws air upwardly through said duct and said hood top opening and through said hood peripheral space creating upwardly moving currents of air along the side walls and end walls of said hood and vertically therebelow, entraining powder particles not adhering to the coated surfaces of the sheets and circulating within the hood and said housing beneath the hood, and adjacent areas, to carry the air entrained powder particles to said blower/filter means for removal of the powder particles from the air and to discharge filtered air from said blower/filter means.

2. The hood assembly of claim 1 wherein the hood is positioned above and after said dispenser means, is spaced above said conveyor, and has a length at least as wide as said conveyor.

3. The hood assembly of claim 1 wherein the hood top opening is positioned centrally of the hood top and the hood baffle is mounted with the ends thereof equidistant from the hood end walls and the sides thereof equidistant from the hood side walls.

4. The hood assembly of claim 3 wherein the peripheral space between the baffle ends and the hood end walls and between the baffle sides and the hood side walls is between 2 to 4 inches.

5. The hood assembly of claim 4 wherein the peripheral space between the baffle ends and the hood end walls and between the baffle sides and the hood side walls is about 3 inches.

6. The hood assembly of claim 3 wherein the space between the hood top and said hood baffle is about ⅓ the height of hood.

7. The hood assembly of claim 3 wherein the hood baffle is spaced between 2 to 4 inches below the hood top.

8. The hood assembly of claim 7 wherein the hood baffle is spaced about 3 inches below the hood top.

9. A system for collecting and treating air entrained particulate powder arising from the operation of a multi-stand printing press, including a delivery end housing having a top with an opening spaced from the end thereof and a bottom opening, and first and second sides, a conveyor having upper and lower flights with spaced gripper means for moving sheets coated on the top surfaces thereof through the press and delivery end housing, dispenser means for applying powder downwardly onto the coated surfaces of the sheets for adherence to the undried portions thereof to promote effective stacking after such sheets are released by the gripper means and descend through the delivery end housing bottom opening, comprising:

(A) a hood assembly comprising:
(1) a hood connected with the delivery end housing top and having:
(a) an open bottom registering with the housing top opening,
(b) first and second side walls,
(c) first and second end walls, and
(d) a top having:
(i) an opening therein;
(B) baffle means within the hood and having:
(1) first and second sides, and
(2) first and second ends;
(C) a peripheral space within the hood, between said baffle means first side and hood first side wall, baffle means second side and hood second side wall, baffle means first end and hood first end wall and baffle means second end and hood second end wall;
(D) a duct having:
(1) a first end connecting with the hood top opening, and
(2) a second end;
(E) blower/filter means comprising:
(1) a housing having:
(a) a central compartment,
(b) a first end compartment having:
(i) an end opening connecting with the duct second end, and
(ii) filter media therein;
(2) blower means having:
(a) a shell having
(i) an air inlet means, and
(ii) discharge portion.

10. The system of claim 9 wherein the hood is positioned above and after said dispenser means and has a length at least as wide as said conveyor.

11. The system of claim 9 wherein the hood top opening is positioned centrally of the hood top and the hood baffle is mounted with the ends thereof equidistant from the hood end walls and the sides thereof equidistant from the hood side walls.

12. The system of claim 11 wherein the peripheral space between the hood baffle ends and the hood end walls and between the hood baffle sides and the hood side walls is between 2 to 4 inches.

13. The system of claim 11 wherein the peripheral space between the hood baffle ends and the hood end walls and between the hood baffle sides and the hood side walls is about 3 inches.

14. The system of claim 11 wherein the space between said hood top and said hood baffle is about ⅓ the height of said hood.

15. The system of claim 14 wherein the hood baffle is spaced about 3 inches from said hood top.

16. The invention of claim 9 wherein the blower/filter means housing first end compartment has:
(A) an outer section with
(1) first filter media; and
(B) a second section having
(2) second filter media therein.

17. The invention of claim 16 wherein the blower/filter means housing first end compartment has
(A) inner section having
(1) a third filter media.

18. The invention of claim 9 wherein the blower/filter means housing further comprises:
(A) a second end compartment having:
(1) an end opening, and
(2) filter media therein.

19. The invention of claim 9 wherein the blower/filter means housing second end compartment has
(A) an outer section having
(1) an end opening, and
(2) first filter media therein.
(B) a second section having
(1) second filter media therein.

20. A system for collecting and treating air entrained particulate powder arising from the operation of a multi-stand printing press, including a delivery end housing having a top with an opening spaced from the end thereof, a bottom opening, and first and second sides, a conveyor having upper and lower flights with spaced gripper means for moving sheets coated on the top surfaces thereof through the press and delivery end housing, dispenser means for applying powder downwardly onto the coated top surfaces of the sheets, for adherence to the undried portions thereof to promote effective stacking thereof after such sheets are released by the gripper means and descend through the delivery end housing bottom opening, comprising:

(A) a hood assembly comprising:
(1) a hood connecting with said delivery end housing and having:
(a) an open bottom registering with top opening thereof,
(b) first and second side walls,
(c) first and second end walls, and
(d) a top having:
(i) an opening therein;
(B) baffle means within said hood having:
(1) first and second sides, and
(2) first and second ends;
(C) a peripheral space within said hood between said baffle means first side and hood first side wall, baffle means second side and hood second side wall, baffle means first end and hood second end wall, and baffle means second end and hood second end wall;
(D) a first duct having:
(1) a first end connecting with the hood top opening, and
(2) a second end;
(E) blower/filter means comprising:

(1) a housing having:

(a) a first end compartment having:

(i) a first end opening connecting with the duct second end, (ii) filter media therein, and (iii) a second end opening, (b) a second end compartment having:

(i) a first end opening, (ii) filter media, and (iii) second end opening, (c) a central compartment having:

(i) a first opening connecting with said first end compartment second end opening, and (ii) a second opening connecting with said second end compartment second end opening, and (d) blower means mounted within the blower/-filter means housing central compartment and having (i) a shell having: air inlet means and air discharge means.

21. The system of claim 20 wherein the blower means has a capacity between 2000 and 4000 CFM.

* * * * *

UNITED STATES PATENT AND TRADEMARK OFFICE

CERTIFICATE OF CORRECTION

PATENT NO. : 5,265,536

DATED : November 30, 1993

INVENTOR(S) : James S. Millard

It is certified that error appears in the above-indentified patent and that said Letters Patent is hereby corrected as shown below:

Col 7, line 15, "Figs 1, 2 a 3" should read --Figs. 1, 2 and 3---.

Col. 7, line 16, after "invention" the words --is associated-- should be inserted.

Col. 7, line 17, after "delivery" the word --end-- should be inserted.

Col. 12, claim 1, line 31, "(4) a top having an connecting" should read --(4) a top having an opening therein connecting--.

Signed and Sealed this

Sixteenth Day of August, 1994

Bruce Lehman

*Attest:*

BRUCE LEHMAN

*Attesting Officer*

*Commissioner of Patents and Trademarks*